United States Patent [19]

Skaats

[11] 4,142,515

[45] Mar. 6, 1979

[54] TIMED WATER RECIRCULATION SYSTEM

[76] Inventor: Loren E. Skaats, 3317 E. 9th St., Indianapolis, Ind. 46201

[21] Appl. No.: 826,302

[22] Filed: Aug. 22, 1977

[51] Int. Cl.[2] ..... F24H 1/00; F04B 49/00

[52] U.S. Cl. ..... 126/362; 417/12

[58] Field of Search ..... 417/12, 38; 137/334, 137/341; 126/362

[56] References Cited

U.S. PATENT DOCUMENTS

| | | | |
|---|---|---|---|
| 1,780,379 | 11/1930 | Durdin, Jr. | 126/362 |
| 2,535,752 | 12/1950 | O'Connell | 126/362 |
| 2,827,912 | 3/1958 | Lung | 137/341 |
| 2,948,277 | 8/1960 | Dennis | 126/362 |
| 2,983,487 | 5/1961 | MacKay | 126/362 |
| 3,123,065 | 3/1964 | Conley | 126/362 |
| 3,499,423 | 3/1970 | Phlaum | 126/362 |
| 3,663,831 | 5/1972 | Cook | 417/12 |
| 3,870,228 | 3/1975 | Mosely | 126/362 |
| 3,885,584 | 5/1975 | Hock | 137/334 |

FOREIGN PATENT DOCUMENTS

| | | | |
|---|---|---|---|
| 1116208 | 5/1965 | United Kingdom | 126/362 |

OTHER PUBLICATIONS

Publication by O-E Specialty Manufacturing Co., patented O-E Venturi Hot Water Circulation Fitting published approximately 1928.

*Primary Examiner*—William L. Freeh

*Attorney, Agent, or Firm*—Woodard, Weikart, Emhardt & Naughton

[57] ABSTRACT

Apparatus for effecting a timed recirculation of the hot water in a water distribution network such as for an apartment complex. A recirculating pump is responsive to a drop in pressure in the hot water output line of a water heater and provides recirculation of the water in the hot water lines from the remote apartment locations for a timed interval. After the timed interval, and after the system has returned to the starting pressure, the recirculating pump is again ready for operation at the time of the next use of the hot water in the system.

4 Claims, 2 Drawing Figures

TIMED WATER RECIRCULATION SYSTEM

BACKGROUND OF THE INVENTION

1. Field of the Invention

This invention is in the field of water recirculation systems. 2. Description of the Prior Art A typical hot and cold running water system, such as is found in residential homes, does not include any means for recirculating the hot water from the vicinity of the hot water faucet back to the water heater. This is because the pipes are short enough that upon opening the faucet, sufficient flow is obtained that undue waiting is not necessary before hot water is available at the tap. In commercial establishments and apartment buildings, sometimes the location of the hot water heater for the hot water system is quite remote from some or all of the locations at which hot water is to be used.

One solution to this situation in the past has been the provision of a recirculating pump which continuously moves hot water from the vicinity of the individual taps being utilized by the user back to the water heater so that hot water is continuously available near each of the taps.

The difficulty with this solution to the hot water distribution problem is that it utilizes an excessive amount of energy for the continuous operation of the recirculating pump during times when hot water is not desired at remote locations. A further drawback to this operation is that heat is lost as the hot water is circulated through the pipe distribution system, requiring the expenditure of still more energy by the water heater to return the recirculated water to a proper hot water temperature. One further difficulty which has been encountered in some cases is the effect of the heat losses of the hot water piping to the extent that the floor of the building and even the adjacent cold water pipes are heated excessively by the recirculated hot water in the hot water pipes. Thus, while hot water is continuously available at the hot water faucets, it is extremely difficult to obtain cold water without a long delay since all or much of the water standing in the cold water pipes is heated by the recirculated hot water.

Certain water recirculation systems of which the applicant is aware, though not adapted for use in the presently disclosed apparatus, include those shown in U.S. Pat. Nos. 2,763,281 to Morgan; 2,981,195 to Payne II et al; and 3,786,835 to Finger. Another nonrelated water recirculation system is shown, with a timer mentioned therein, in U.S. Pat. No. 3,639,081 to Gray et al.

SUMMARY OF THE INVENTION

In a hot water distribution system having a pressure-regulated input cold water line, a water heater coupled from said input line, and an output hot water line coupled from the water heater to a plurality of remote hot water service locations, the improvement which comprises a recirculation pump, recirculation water lines coupled from the remote service locations to the recirculation pump, a return water line from the output of the recirculation pump to the water heater, pressure switch means for detecting pressure variations in the output hot water line and timer means for, in an initial condition, energizing the recirculation pump for a predetermined period of time in response to a pressure decrease detected by the pressure switch means.

It is an object of the present invention to provide hot water in a water distribution system at points remote from the hot water heater with a timed hot water recirculation apparatus which conserves energy and does not radiate excess heat to the environment.

It a further object of the present invention to provide such an apparatus which includes means for activating a recirculating pump in a hot water distribution system in response to changes in the hot water line pressure.

Further objects and advantages of the present invention shall be apparent in the following detailed description and accompanying figures.

DESCRIPTION OF THE PREFERRED EMBODIMENT

Figure 1:
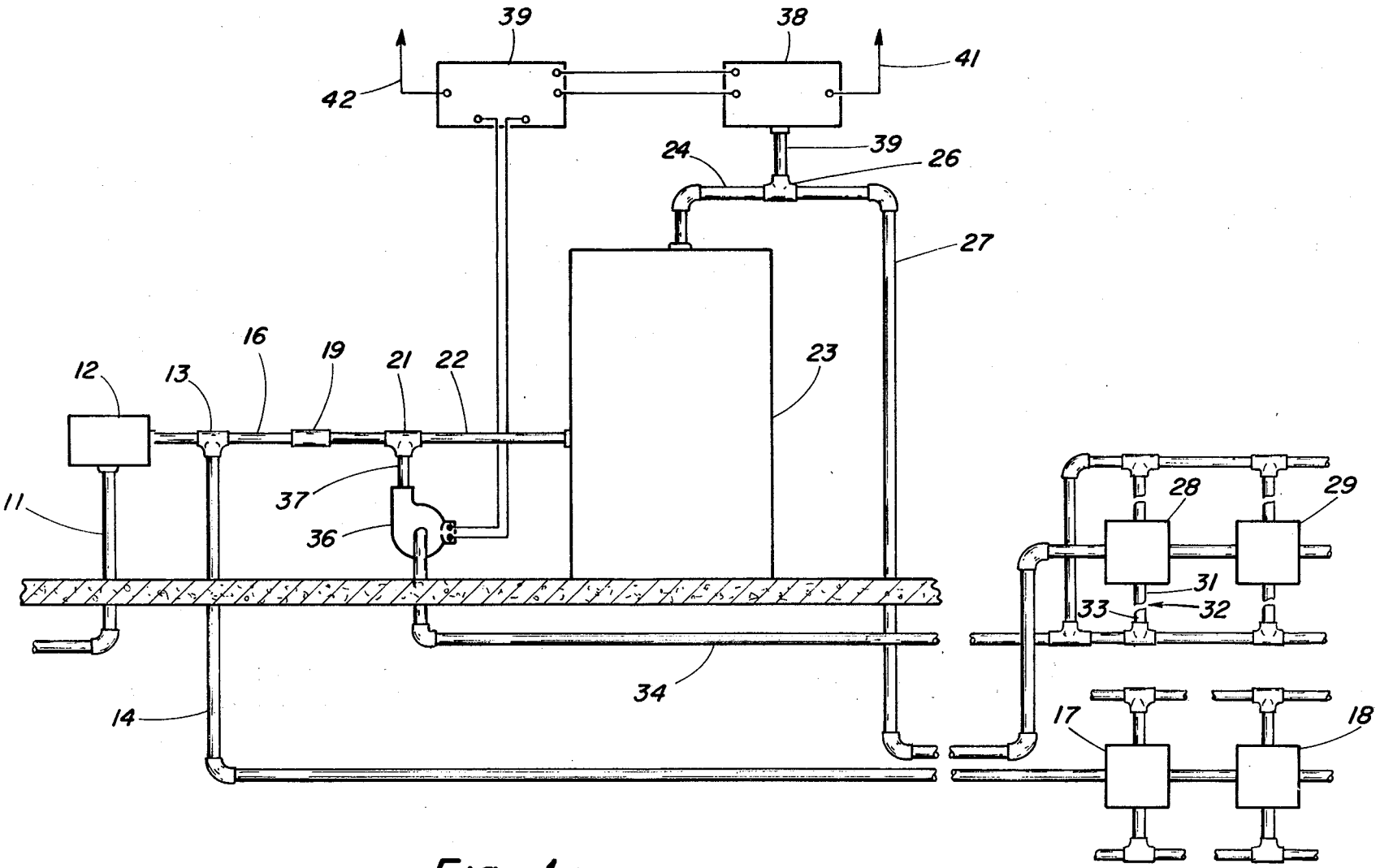
FIG. 1 is a diagrammatic showing of a water distribution system embodying the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to FIG. 1, a cold water line 11 is supplied from a standard water main and couples the cold water to a pressure regulator 12 which maintains a constant downside pressure generally slightly below lowest main pressure. The constant pressure cold water from the outlet of pressure regulator 12 is coupled to a T connection 13 which provides a cold water line 14 and a line 16 for coupling water to the water heater. Cold water line 14 supplies water to a plurality of cold water outlets at a remote location such as through heads 17 and 18, each of which might supply 4 locations, such as apartments, as shown.

Cold water in line 16 is coupled through a check valve 19 which permits flow only in the direction toward T connection 21. At T connection 21 recirculated hot water, as shall be described hereinafter, is added to the incoming cold water and this combination is fed through line 22 to a hot water heater 23. Hot water from the hot water heater is supplied through pipe 24 to T connector 26 which includes a branch for connecting to a pressure switch 38 to be described hereinafter. The hot water from pipe 24 flows through T connector 26 and pipe 27 to the hot water distribution system which includes, for example, heads 28 and 29. Each exemplary head is a distribution point for two hot water outlets. For example, pipe 31 from head 28 is coupled to a remote location where one or more hot water faucets are provided in the area indicated at 32. Then a return pipe 33 is provided to couple hot water past the faucets at location 32 and back through return pipe 34 to a recirculation pump 36.

When pump 36 is activated it recirculates the hot water from the various remote locations to T connection 21 and the recirculated water from the hot water distribution system is combined as necessary with incoming cold water through pipe 22 and recirculated to water heater 23. Check valve 19 prevents flow from line 37 at the output of pump 36 from flowing backward into the cold water supply pipes.

A pressure switch 38, is coupled through pipe 39 and T connector 26 to output line 24 of the water heater 23. Pressure switch 38, such as is available from the Pressure Switch Company of Olathe, Kansas, senses a differential in the output pressure in line 24, such as results when hot water lines are opened at the remote locations of the system. When activated by a pressure drop in line 24, pressure switch 38 couples electrical power from line 41 to timer mechanism 39 and thence to pump 36, activating the pump, and to the other side power line 42. Pump 36 recirculates hot water past the remote hot water tap locations back to the water heater 23 for a predetermined time set by timer 39. After this time interval of, for example, 45 seconds the power to pump 36 is disconnected by operation of timer mechanism 39, and the timer mechanism does not reset for further activation of pump 36 until the pressure in pipe 24 has returned to normal indicating that water use at the remote locations has ceased. Line 42 is the other power line coupled together with line 41 from a standard source of electrical power.

In normal operation of the system, such as for an apartment complex, the first user of hot water on a particular day opens a hot water faucet such as at location 32 remote from water heater 23, causing a decrease in the hot water line pressure in pipe 24. Pressure switch 38 senses the pressure drop and activates pump 36 to begin recirculating hot, or (for the moment) warm water, through pipes 31 and 33 past the hot water taps such as at location 32. Simultaneously hot water is being circulated past all of the other tap locations of the hot water system and returns through pipe 34 to recirculation pump 36. In this manner, a user of hot water such as at location 32, rather than waiting for hot water from water heater 23 until all of the warm water has cleared from pipes such as 27 through a faucet at location 32, obtains hot water quickly through recirculation of water through pipe 34 and the other recirculation pipes through the operation of recirculation pump 36. For example, a user might have to wait a few seconds for hot water using the presently described system as opposed to as much as four minutes if there were not recirculation. The recirculation pump 36 is timed through timer mechanism 39 to operate for whatever period of time is determined to be necessary in a given system to recirculate the hot water sufficiently that truly hot water is supplied at all of the remote locations. In the exemplary 45 second operation, the hot water will have reached all remote locations at this time, and timer mechanism 39 deactivates recirculation pump 36 after the 45 seconds. Continued use of hot water, or possibly the contemporaneous use of a large amount of cold water such as for lawn watering, prevents timer mechanism 39 from resetting so that pump 36 will not be reactivated until all users of water have allowed the pressure to return to normal in pipe 24. A subsequent opening of a hot water outlet after reset once again initiates the 45 second recirculation cycle.

In the system shown in FIG. 1, operation of one of the cold water outlets to supply a large amount of water also affects the pressure in pipe 24 since the pressure for pipe 24 of the hot water system is provided through main pipe 11 and pressure regulator 12 rather than by any separate pressurizing system for the hot water. The use of timing mechanism 39 prevents the continuous operation of pump 36 by requiring a reset interval where the system is returned to full pressure before the recirculation pump can be activated for another 45 second timer interval; therefore, the operation of a lawn sprinkler or other large cold water-using operation can not result in continuous use of recirculation pump 36.

Figure 2:
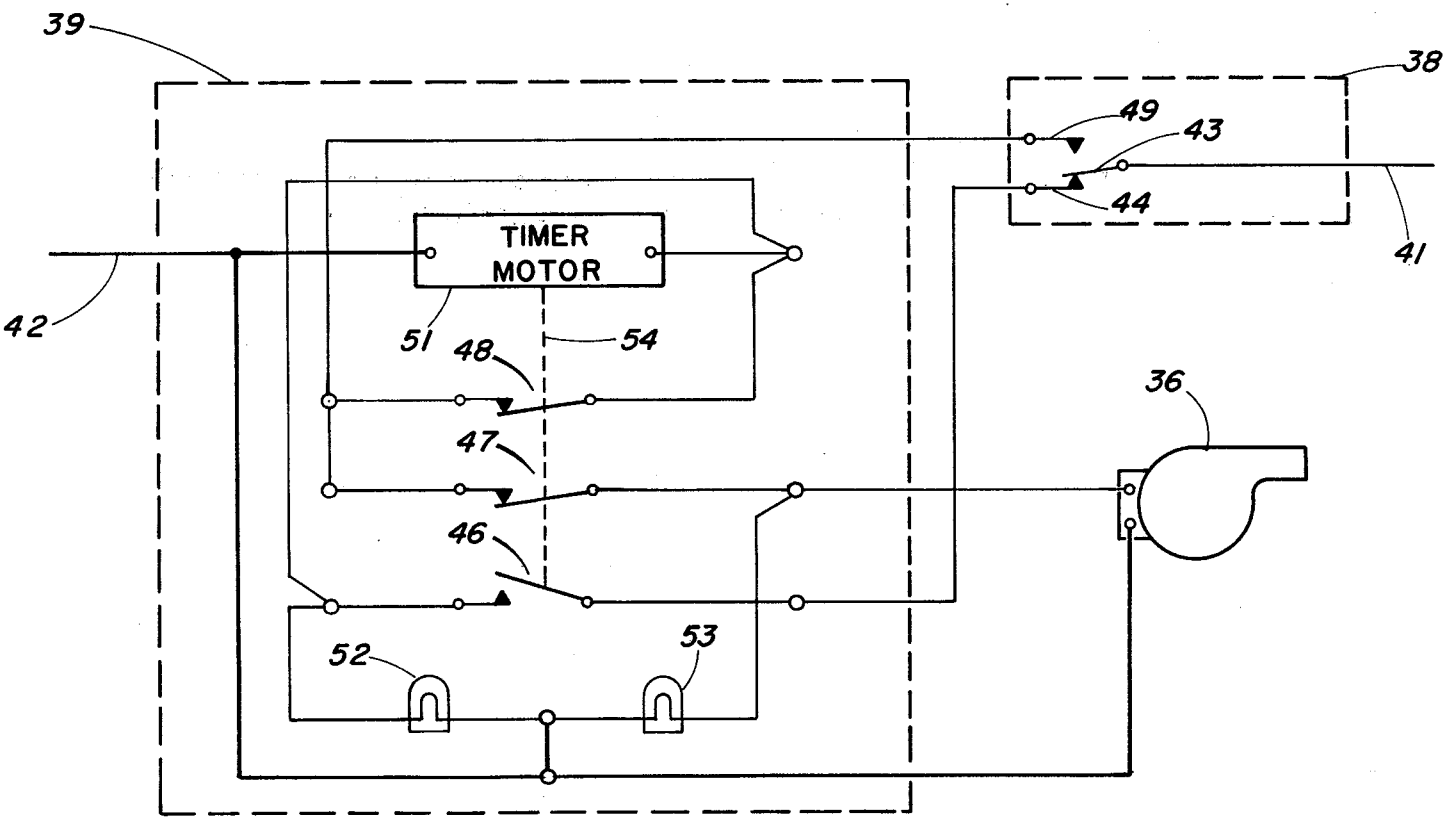
FIG. 2 is a circuit diagram of the timer and pump control circuitry of the embodiment of FIG. 1.

Referring now to FIG. 2, there is shown a schematic diagram of the electrical circuitry of timer mechanism 39, pressure switch 38 and recirculation pump 36. In an initial condition where timer mechanism 39 and recirculation pump 36 are ready to operate, with the hot water system at normal pressure, switch arm 43 in pressure switch 38 is in the position shown contacting swich contact 44 which couples incoming power line 41 to the open control switch 46. At this time switches 47 and 48 of the timer mechanism are closed.

When the pressure drops in hot water line 24 (FIG. 1), pressure switch 38 moves contact arm 43 upwardly touching contact 49. This completes a circuit between power line 41 and the other side power line 42 through several circuits. The power connection is made through contact 49 and switch 48, energizing timer motor 51 and also supplying power to bulb 52, which serves as an indicator that the timer motor is in operation. Power is also coupled through contact 49 and switch 47 to energize recirculation pump 36 and bulb 53, indicative of the operation of the recirculation pump.

After a predetermined time has elapsed, such as the exemplary 45 seconds discussed above, timer motor 51 by conventional cam operation, indicated diagrammatically as dotted line 54, closes switch 46 and simultaneously opens switches 47 and 48. This switching removes power from the timer motor and the recirculation pump and also both of the indicator bulbs 52 and 53. Arm 43 of pressure switch 38 remains in contact with contact 49, and therefore no electrical power is coupled through contact 44 and now-closed switch 46. During the 45 seconds before the timer motor has timed out, recirculation pump 36 has been in operation and has supplied hot water to the various remote locations in the system. Further use of the hot water at the remote locations will maintain the flow of the hot water and assure that hot water of the proper temperature is available at the remote locations without the operation of recirculation pump 36.

At such time as all users of water have completed their use, the pressure will return to normal in the hot water line 24 (FIG. 1), and pressure switch 38 will return contact arm 43 to the position shown in FIG. 2, touching contact 44. Electrical power is now coupled between lines 41 and 42 through now-closed switch 46 both activating timer motor 51 and energizing bulb 52 indicating the operation of the timer motor. The timer motor 51 completes its cycle and the cam operated switches 46 through 48 are returned to the position shown in FIG. 2. With switch 46 now open, power is no longer coupled from contact 44, and timer motor 51 and indicator bulb 52 are deactivated. Pump 36 also remains off at this time. However, the system is now returned to its initial condition, and the timer motor 51 and recirculation pump 36 will again operate when a pressure drop occurs in the hot water line.

While there have been described above the principles of this invention in connection with specific apparatus, it is to be clearly understood that this description is made only by way of example and not as a limitation in the scope of the invention.

What is claimed is:

1. In a hot water distribution system having a pressure-regulated input cold water line, a water heater coupled from said input line, and an output hot water line coupled from the water heater to a plurality of remote hot water service locations, the improvement which comprises:

an electrically operated recirculation pump;

recirculation water lines coupled from the remote service locations to the recirculation pump;

a return water line from the output of the recirculation pump to the water heater;

pressure switch means responsive to pressure in the output hot water line, timer operated switch means, and circuit means connecting both of said switch means and said pump for energizing said pump in response to a predetermined pressure decrease in said output hot water line, subsequently deenergizing the pump after a predetermined time interval and thereafter preventing reenergization of said pump until said pressure switch responds to a predetermined pressure increase in said output hot water line.

2. The improvement of claim 1 in which said pressure switch means includes switch contacts closed only upon said predetermined pressure decrease and further switch contacts closed only upon said predetermined pressure increase.

3. The improvement of claim 1 in which said timer operated switch means includes a control switch which is actuated upon deenergization of said pump at the termination of said predetermined time interval to reset said circuit means for the next cycle of operation of the pump upon response of said pressure switch means to said predetermined pressure increases.

4. The improvement of claim 3 in which said predetermined time interval is relatively short and of the order of forty-five seconds.

* * * * *